US005836033A

United States Patent [19]

Berge

[11] Patent Number: 5,836,033

[45] Date of Patent: Nov. 17, 1998

[54] TOOTHBRUSH FOR BRUSHING TEETH AND MASSAGING GUMS

[76] Inventor: Harald Berge, Sokolovskà 61, 186 06 Praha 8, Czech Rep.

[21] Appl. No.: 612,954

[22] PCT Filed: Aug. 29, 1994

[86] PCT No.: PCT/NO94/00142

§ 371 Date: Jun. 17, 1996

§ 102(e) Date: Jun. 17, 1996

[87] PCT Pub. No.: WO95/07036

PCT Pub. Date: Mar. 16, 1995

[30] Foreign Application Priority Data

Sep. 10, 1993 [NO] Norway ..... 933240

[51] Int. Cl.[6] ..... A46B 9/04

[52] U.S. Cl. ..... 15/110; 15/167.1; 15/207.2; 15/DIG. 5; 300/21

[58] Field of Search ..... 15/110, 167.1, 15/207.2, DIG. 5, DIG. 6; 300/17, 18, 21; 610/139, 141

[56] References Cited

U.S. PATENT DOCUMENTS

| | | | |
|---|---|---|---|
| 1,022,920 | 4/1912 | Anderson . | |
| 1,188,823 | 6/1916 | Plank . | |
| 1,251,250 | 12/1917 | Libby . | |
| 1,268,544 | 6/1918 | Cates . | |
| 2,088,839 | 8/1937 | Coney et al. . | |
| 2,139,245 | 12/1938 | Ogden . | |
| 2,548,255 | 4/1951 | Cressler | 15/207.2 |
| 3,263,258 | 8/1966 | Burge | 15/167.1 |
| 3,553,759 | 1/1971 | Kramer et al. . | |
| 4,277,862 | 7/1981 | Weideman | 15/110 |
| 4,288,883 | 9/1981 | Dolinsky . | |
| 4,472,853 | 9/1984 | Rauch . | |
| 4,571,768 | 2/1986 | Kawashima . | |
| 4,724,569 | 2/1988 | Eguchi et al. | 15/207.2 |
| 5,007,686 | 4/1991 | Klein et al. | 300/21 |
| 5,015,504 | 5/1991 | Gent et al. | 300/21 |

FOREIGN PATENT DOCUMENTS

| | | |
|---|---|---|
| 0247224 | 2/1987 | European Pat. Off. . |
| 0360766 | 3/1990 | European Pat. Off. . |
| 3116189 | 12/1982 | Germany . |
| 3433763 | 2/1986 | Germany . |
| 298310 | 4/1990 | Japan . |
| 333001 | 3/1959 | Switzerland . |
| 401903 | 11/1965 | Switzerland ..... 15/207.2 |
| 664271 | 4/1984 | Switzerland . |
| 2035076 | 6/1980 | United Kingdom . |
| 2178304 | 2/1987 | United Kingdom . |

*Primary Examiner*—Terrence Till
*Attorney, Agent, or Firm*—Frost & Jacobs LLP

[57] ABSTRACT

Improvement in a toothbrush (301), especially for the combined brushing of teeth and massaging of gums, comprising a plurality of toothbrush bristles attached at their one end to the head (302) of the toothbrush and having their other end extending freely from said head, the improvement comprising one or more inner rows or groups of bristles (303*a*, 303*b*) of ordinary cleaning quality in combination with adjacent outer rows or groups of bristles (304*n*, 305*n*) of smaller height than said inner rows of bristles, said outer bristles provided with free rounded end portions (306).

9 Claims, 2 Drawing Sheets

TOOTHBRUSH FOR BRUSHING TEETH AND MASSAGING GUMS

FIELD OF THE INVENTION

The present invention relates to an improvement in a toothbrush, especially for combined brushing of the teeth and massage of the gum, and comprising a plurality of toothbrush bristles attached at their one end to the head of said toothbrush and having their other end extending freely therefrom, as well as to the manufacturing thereof.

PRIOR ART

U.S. Pat. No. 1,022,920 discloses a toothbrush for combined cleaning and massage, which comprises two set of brushes comprising inner bristles and outer surrounding rubber bristle parts. The combined cleaning and massage takes place in that the inner bristles will be screened off and be prevented from coming into contact with the gums, whereas the outer brush parts comprising the rubber bristles will provide the massaging effect, for thus by means of this massage to strengthen and indurate delicate and soft gums.

U.S. Pat. No. 1,188,823 relates to an insert which can be used in connection with toothbrushes, namely to provide a combined massage of the gums, at the same time as the tooth surfaces are cleansed by the bristles of the toothbrush. This insert takes the form of a sleeve which is put on to the head of the toothbrush for thereby surrounding the ordinary toothbrush bristles.

U.S. Pat. No. 1,251,250 also relates to a combination toothbrush, comprising inner bristles and outer resilient bristles, said inner bristles being provided as hard bristles as known per se, whereas the outer bristles are provided from rubber or similar resilient material.

U.S. Pat. No. 1,268,544 discloses a toothbrush having regular outer toothbrush bristles, whereas in the middle of the brush there are provided a plurality of suction cups, the upper edges of which being aligned with the free upper ends of the outer bristles. Said suction cups and their stems are preferably provided from rubber. These cups are used as the massaging part of the toothbrush, said cups influencing the gums with a kneading effect for increasing the blood circulation thereof.

U.S. Pat. No. 3,553,759 also relates to a combination brush having a toothbrush head comprising inner cleaning bristles and outer massaging brushes made from rubber and having a length which extend beyond the length of the inner cleaning bristles. According to this publication it is also suggested that the outer resilient rubber massaging bristles have outer portions which are expanded or providing a larger surface and thereby a better stimulating effect when treating the gums.

In FIG. 2 of said U.S. Pat. No. 3,553,759 it is depicted that the bristles may be arranged in tufts or clusters, but the outer soft material constituting the tips have an extension which is longer than the inner bristles used for cleaning purposes. Besides, said tufts or clusters depicted in FIG. 2 of U.S. Pat. No. 3,553,759 are arranged obliquely, and nowhere in this specification are any indications made for substantially vertical bristles which are shorter than the cleaning bristles and being formed to merge into an integrated rounded end portion.

From U.S. Pat. No. 4,571,768 there is known a toothbrush having a plurality of bristles of ordinary length and ordinary quality for example nylon, whereas inbetween said ordinary bristles there are provided lower elements comprising a permanent magnet. Said normal bristles render a cleaning function and only when pushing harder on the toothbrush the lower elements will come into contact with the gums for the stimulation thereof, at the same time as the gums are influenced by the magnetic field from the permanent magnet. However, it is believed that the location of the magnetic elements in the centre of the toothbrush will entail that the remaining ordinary brushes 2 will treat the gums unnessecarily hard when said elements are intended to provide a massage function.

U.S. Pat. No. 4,277,862 relates to a combination brush having inner cleaning bristles extending beyond adjacent massage means which are provided as plate shaped means having upper portions including slits therein.

GB 2,178,304 relates to a toothbrush having a brushing surface which is provided obliquely to or being provided with a curved shape as viewed in the transversal direction, for thereby improving the cleaning of the transition portion between the tooth root and the gum.

GB 2,035,076 relates to a combination brush comprising a brush head having a central portion including cleaning bristles and having an outer portion including massage bristles, preferably provided on each side of the central cleaning bristles. According to this publication it is suggested that a toothbrush head should have a curved sectional profile, such that the outer and inner bristles can come into effect in accordance with a particular patern.

EP 0,247,224 also relates to a combination brush wherein all the bristles have an upper spheric portion at the ends, said bristles also having different length, and the difference between the longest and the shortest bristles being in the range of 1–4 mm. The bristles are mounted in such a manner on the toothbrush head, that bristles having equal length do not correspond locally, which will prevent that the spherical portions will be in touch with each other.

DE 3,433,763 also relates to a combination brush having various types of bristles, and is especially directed to an improved cleaning effect. This is achieved by giving the outer bristles a greater length than the inner bristles, the tips of each bristle being rounded by means of mechanical treatment. The inner bristles are by means of hot air provided with an extended top portion for example in the form of a mushroom.

OBJECTS OF THE INVENTION

An object of the present invention is to provide a toothbrush which has the effect of preventing loosened gums and a subsequent development of bacterias in the gum pockets.

Another object of the present invention is to provide a toothbrush comprising an inner area of substantially vertically provided single bristles adapted for cleaning purposes, and outer set or groups of substantially vertically provided single brushes having a somewhat lower extension and a common rounded portion for massage functions.

Still another object of the present invention is to provide a toothbrush wherein most of the brushes are substantially vertical and substantially parallel whether used for cleaning or massage purposes.

Yet another object of the present invention is to provide a toothbrush wherein the bristles for cleaning purposes have different lengths, and wherein the groups or sets of massage bristles are arranged outwardly thereof and not being higher than said cleaning bristles.

Still another object of the present invention is to provide a toothbrush having cleaning bristles which at the front of the head portion of the toothbrush comprises longer but softer cleaning bristles compared with the remaining cleaning bristles of the toothbrush, and at the same time comprising lower sets of massage bristles.

A further object of the present invention is to provide a method for manufacturing a toothbrush, which manufacturing is based on a toothbrush with ordinary bristles, which may be of various length and softness, but which during the manufacturing stage will have their outer bristles in groups or clusters thereof processed to be merged into a common rounded top portion for massage function.

Still another object of the present invention is to provide a method wherein finished toothbrushes appearing in a production line or coming from stock, are further processed to let groups or clusters thereof be processed for merging into common rounded, free end portions for massage function.

BRIEF DISCLOSURE OF THE INVENTION

This object is achieved by a toothbrush of the type stated in the introductory part, which in accordance with the present invention is improved by comprising one or more inner rows of bristles of ordinary cleaning quality in combination with adjacent outer rows of bristles of smaller height than said inner rows of bristles and provided with free rounded end portions.

Further features and advantages in connection with the present toothbrush will appear from the following description taken in conjunction with the attached drawing.

BRIEF DISCLOSURE OF THE DRAWINGS

DISCLOSURE OF PREFERRED EMBODIMENTS

Figure 1:
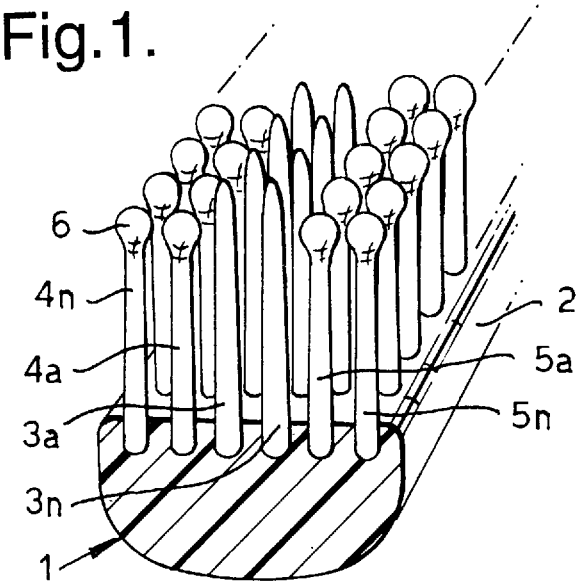
FIG. 1 is a perspective view partly in section of the head of a toothbrush embodiment according to the present invention.

In FIG. 1 which illustrates an embodiment of the present toothbrush, the toothbrush itself is designated by reference numeral 1 and comprises a plurality of toothbrush bristles attached at their one end to the head 2 of the toothbrush 1 and having their other end extending freely therefrom. In order to prevent loosened gums with an associated development of bacteria in the gum pockets, there is according to the present invention suggested that the toothbrush comprises one or more inner rows 3*a*, 3*n* of bristles of ordinary cleaning quality in combination with adjacent outer rows 4*a*–4*n* and 5*a*–5*n*, respectively, of bristles of smaller height than said inner rows 3*a*–3*n* of bristles and provided with free rounded end portions 6.

In the embodiment illustrated in FIG. 1 the free rounded end portions 6 of each of the outer bristles 4*a*–4*n*, 5*a*–5*n* are somewhat expanded in relation to the average diameter of the remaining bristle, for thereby being prevented from penetrating into the spaces between the teeth of the user, but for thereby effecting massaging and stimulating treatment of the gum or gums during toothbrushing.

In the illustrated embodiment the inner rows 3*a*–3*n* of bristles comprise two rows, whereas each row is constituted by individual mutually spaced bristles. However, it is to be understood that other configurations may be contemplated, for example that the inner rows of bristles may comprise set or groups of thinner bristles having the same function as corresponding single individual bristles.

In the embodiment illustrated in FIG. 1 it is also suggested that the outer rows 4*a*–4*n*, 5*a*–5*n* of lower bristles comprise individual bristles with expanded end portions 6, i.e. two rows thereof on each side of the two rows 3*a*–3*n* of inner longer bristles.

However, it is to be understood that also the outer lower bristles could be arranged in set or groups of thinner bristles with a common expanded free end portion.

In the illustrated embodiment of FIG. 1 the toothbrush 1 comprises six rows of bristles embeded in the toothbrush head 2, the central rows 3*a*, 3*n* thereof being of ordinary brushing quality, whereas each of the pairs of adjacent outer rows 4*a*, 4*n* and 5*a*, 5*n*, respectively, of bristles are lower and provided with rounded free ends 6 for example of plastic or rubber.

It should be understood that the bristles 3*a*, 3*n* of the central rows could be made of a relatively soft material which when used with moderate quantities of tooth paste including moderate quantities of an abrasing material, will reduce the wear of the tooth enamel to a minimum.

Figure 2:
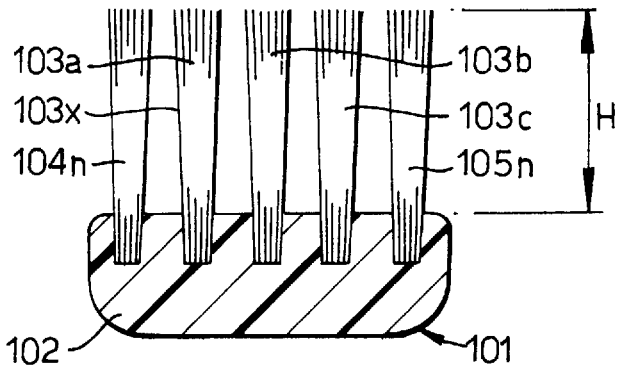
FIG. 2 is a section through the head portion of a toothbrush blank according to the present invention, during a first step of the manufacturing process.
Figure 3:
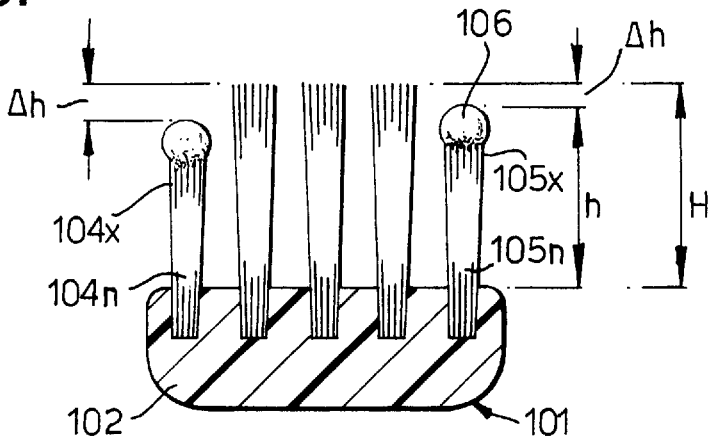
FIG. 3 is a section similar to FIG. 2 and illustrates the embodiment at a finishing step of the manufacturing process.

In the embodiment illustrated in FIGS. 2 and 3 there is illustrated a section through a toothbrush 101 comprising a toothbrush head 102, said toothbrush head 102 being provided with inner rows of bristles, attached thereto, here in a three-row arrangement, 103*a*, 103*b* and 103*c*, respectively, but herein the rows are compiled by set or groups of bristles 103*x*. Said groups or clusters of bristles have the same function as a corresponding single brush, but here giving a group function as regards the cleaning function.

Further, there are in FIGS. 2 and. 3 illustrated set or groups of outer bristles 104*n* and 105*n*, respectively, arranged outwardly of said inner set of cleaning bristles. FIG. 2 is to be regarded as a section through for example an ordinary toothbrush, which primarily was intended to be used for cleaning only of the teeth, since all of the brushes are here provided with the same height H, and without the outer rows of groups of bristles 104*n* and 105*n* being processed for any special massage function.

However, in FIG. 3 there is illustrated a later step in the production process compared with FIG. 2, wherein the outer rows of groups of bristles, 104*n* and 105*n*, respectively, comprising individual thinner bristles 104*x* and 105*x*, have been processed in such a manner so as to provide, or been provided with individual, rounded outer end portions 104, whereby said outer massage groups 104*n* and 105*n* will be provided with a lower height h compared with the central bristles 103*a*–103*c* which still have the original height H.

The difference in height Ah between the central bristles 103*a*–103*c* and the outer bristles 104*n* and 105*n*, will entail that whereas the central bristles will be given access between the teeth of the user during a toothbrushing operation, the outer shorter groups of bristles will at the same time provide a gentle but effective massage of the gums.

By the technique discussed in connection with FIGS. 2 and 3, the toothbrush according to the invention may be manufactured from a toothbrush comprising bristles of equal length, but which at a later stage will have outer rows, or parts thereof, of single bristles arranged in groups, processed so that these individual groups will be provided with or be subjected to an appropriate heat treatment, for example by means of microwave radiation, for the procurement of rounded, free end portions suitable for massage functions.

The integrated or processed free end portions 106 of each group of bristles 104*n* and 105*n* including individual groups of bristles being arranged substantially parallel and vertical in relation to the toothbrush head, will entail that each group will be more resilient and have a lamella-like spring effect compared with any individual brushes provided with rounded top portion. The common or integrated top portion of each group of massage bristles can either be provided during the manufacturing of the bristles or bristle groups, or during the manufacturing of the toothbrush itself, or be provided as an after-process of any ordinary toothbrush, the merging together of the outer rows of groups of bristles comprising two or more bristles in each individual group.

Appropriately, the outer portions of such groups can be melted together to form a sphere of rounded integral top portion, and the multibristle groups will then with their common top portions render a favourable vibration effect and thereby a favourable massage effect against the gums when using the toothbrush for cleaning the teeth.

The toothbrush according to the present invention can of course comprise other embodiments which are variants of the embodiments illustrated in FIGS. 1–3, and wherein the number of bristles in each row can vary within wide limits, and wherein the difference in height between the brushing bristles and massage bristles can vary. Further, the softness and the rounded shape of the free ends of the massage bristles may vary in other manners than illustrated in FIGS. 1–3.

Figure 4:
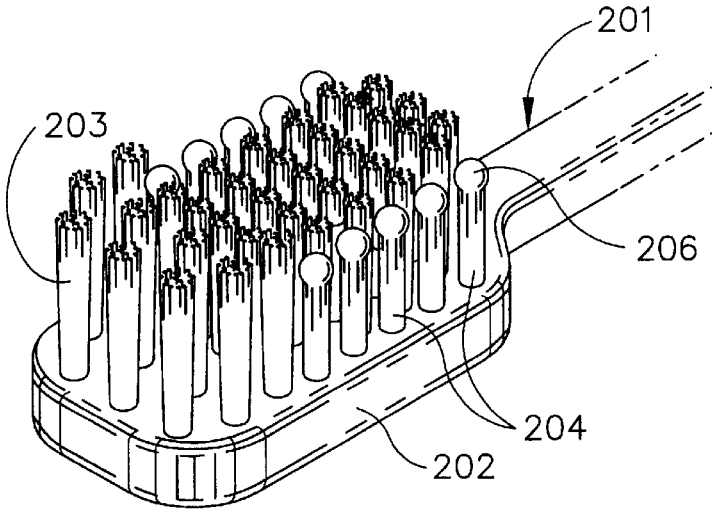
FIG. 4 is a perspective view of the head portion of another embodiment of a toothbrush according to the invention.

One such variation is illustrated in FIG. 4 wherein a toothbrush 201 is made from a brush blank having originally bristles of equal length, here indicated by reference numeral 203 (some bristles deleted for the sake of clarity), but which at a later stage have had a certain number of groups of outer bristles, here indicated by 204, further treated for obtaining proper smaller length and rounded free end portions 206, each group of bristles containing for example 10–20 bristles in each set.

Figure 5A:
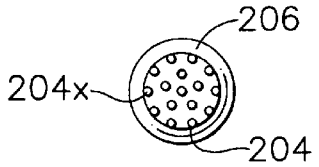
FIG. 5 is a detail on a larger scale of the embodiment according to FIG. 4.
Figure 5B:
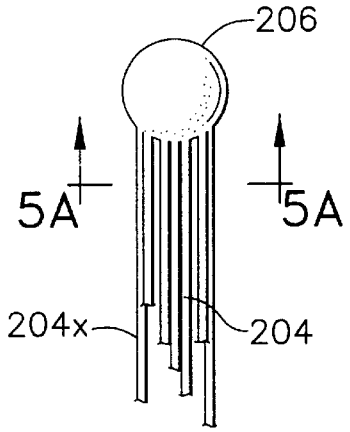

There is illustrated on a larger scale a bottom view (FIG. 5*a*) and a side view (FIG. 5*b*) detail of one such group of bristles. 204, comprising for example 10 individual bristles 204*x*, and at the top thereof having a common or integrated top portion 206 giving the group a lower height than the inner bristles 203 for thereby providing a combination toothbrush for cleaning the teeth and simultaneously massaging the gums.

Figure 6:
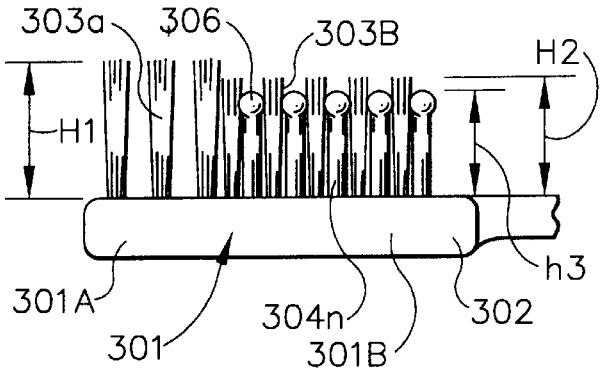
FIG. 6 is a side view of still another embodiment of a toothbrush according to the invention.
Figure 7:
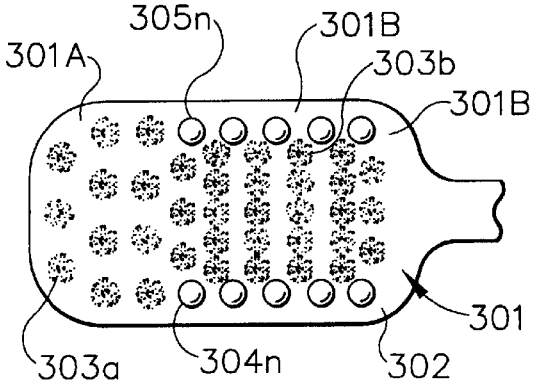
FIG. 7 is a top view of the embodiment illustrated in FIG. 6.

In FIGS. 6 and 7 there is illustrated still another embodiment of the present invention, in which the toothbrush 301 comprises a head 302 provided with a front portion 301A comprising a plurality of individual bristles 303*a* of a first height H1, said bristles being of a relatively soft type. Further the toothbrush head 302 comprises a second portion 301B comprising inner lower bristles 303*b* of height H2 which are not as soft as the first mentioned longer front bristles 303*a*, but having the sane cleansing functions as said longer bristles.

In addition, there are provided outer rows of individual groups of massage bristles 304*n* and 305*n*, respectively, each of said group 304n, 305n having a still lower height h than the height H2 of the lower cleansing bristles 303*b*, and being provided with a rounded free end portion 306 for massage purposes.

It should further be understood that the toothbrush according to the invention could be manufactured by embeding the individual bristles or sets thereof into the toothbrush head with the individual bristles prepared on beforehand, i.e. with adequate length and qualities thereof, whereafter the bristles which are to render massage functions should be prepared for obtaining proper smaller length and rounded free end portions, as explained above, and for thereby implementing further embodiments of the present invention.

What is claimed is:

1. An improvement in a toothbrush comprising a substantially planar head and a handle, especially for combining brushing of the teeth and massage of the gums, and comprising a plurality of toothbrush bristles one end of which is attached to the head of said toothbrush and the other end of which extends freely from the head of said toothbrush, said toothbrush bristles of ordinary cleaning function being arranged in combination with other bristles effecting massage functions, characterized in that the improvement resides in that the toothbrush head comprises an inner area having substantially vertically arranged individual bristles effecting cleansing function, and that said toothbrush head also comprises integrally therewith at least one outer group of substantially vertically arranged individual bristles of length lower than said cleansing bristles, said outer bristles having a rounded portion associated therewith for massage function.

2. The toothbrush as claimed in claim 1, characterized in that most of the bristles of said toothbrush head are substantially vertical and arranged substantially parallel.

3. The toothbrush as claimed in claim 2, characterized by comprising at least two inner rows, constituted by individual mutually spaced bristles or groups of bristles, and in addition comprising outer rows of bristles comprising at least two individual bristles or groups of bristles (104*n*) having a rounded end portion (106) associated therewith.

4. The toothbrush as claimed in claim 3, characterized in that the toothbrush (101) comprises a first number of bristles which are attached to the head (102) of the toothbrush (101), as central rows of bristles (103*a*–103*c*) having a certain height (H) and having ordinary bristle quality, and a second number of outer rows of bristles (104*n*, 105*n*) having a lower height (h) and being provided with rounded free end portions (106).

5. The toothbrush as claimed in claim 4, characterized in that the bristles having cleansing effect are provided from a relatively soft material which when used with moderate quantities of tooth paste including moderate quantities of an abrasing material will reduce the wear of the tooth enamel to a minimum.

6. The toothbrush as claimed in claim 3, characterized in that the toothbrush comprises a first number of bristles (303*a*) which are attached to the head (302) of the toothbrush (301) and having a certain height (H1) and a relatively soft quality, a second number of bristles (303*b*) being of smaller height (H2) than said first bristles (303*a*) and having a medium soft quality compared to said first bristles (303*a*) as well as a third number of bristles (304*n*, 305*n*) arranged on the outside of said first and second number of soft and medium soft bristles (303*b*) and having a lower height (h3) than said first and said second number of soft and medium soft bristles, and being provided with rounded free ends (306).

7. A method for manufacturing a toothbrush, characterized by the following steps:

providing a toothbrush (101) with original bristles of equal length (H) and having a relatively soft quality and outer bristles having a stiffness greater than that of said original bristles, at a later stage further processing a number of said outer bristles (104*n*, 105*n*) for the reduction of the length (h) thereof and providing rounded free end portions (106), so that the toothbrush head comprises an inner area having substantially vertically arranged individual bristles effecting cleansing function, and that said toothbrush head also comprises integrally therewith outer groups of substantially vertically arranged individual bristles of length lower than said cleansing bristles said outer bristles having a rounded top portion associated therewith for massage function.

8. The method as claimed in claim 7, characterized in that the rounded portions (6, 106, 206, 306) are provided by means of heat treatment.

9. A method for manufacturing a toothbrush comprising a handle, a toothbrush head, and bristles, characterized by the following steps:

providing a toothbrush (301) having a first number (303*a*) of bristles of equal length (H1) and having a relative soft quality, arranged at the front end portion (301A) of the toothbrush head (301), and providing a second plurality of bristles (303*b*) on a second portion (301B) of the head (301) of the toothbrush, said second plurality of bristles being stiffer than said first plurality of bristles, further treating a number of outer bristles (304*n*, 305*n*) of said second plurality of bristles (303*b*) for the reduction of the length (h3) thereof such that the height of said outer bristles is less than the height of the remaining second plurality of bristles, and providing on said outer bristles rounded free end portions (306).

* * * * *